United States Patent [19]

Peterson

[11] 4,023,455

[45] May 17, 1977

[54] CIRCUIT FOR IMITATING THE SPEECH CHARACTERISTICS OF REED ORGAN PIPES

[76] Inventor: Richard H. Peterson, 11748 Walnut Ridge Drive, Palos Park, Ill. 60464

[22] Filed: Dec. 17, 1975

[21] Appl. No.: 641,716

[52] U.S. Cl. ..... 84/1.21; 84/DIG. 8; 84/DIG. 9; 84/DIG. 10; 84/DIG. 19

[51] Int. Cl.[2] ..... G10H 1/02; G10H 5/00

[58] Field of Search ..... 84/1.01, 1.11—1.13, 84/1.19–1.21, 1.24, 1.26, DIG. 8, DIG. 9, DIG. 10, DIG. 19

[56] References Cited

UNITED STATES PATENTS

| | | | |
|---|---|---|---|
| 3,570,357 | 3/1971 | Adachi | 84/1.26 |
| 3,614,288 | 10/1971 | Amano | 84/1.21 |
| 3,828,110 | 8/1974 | Colin | 84/1.01 |
| 3,886,836 | 6/1975 | Hiyoshi | 84/1.26 |
| 3,911,776 | 10/1975 | Beigel | 84/1.11 |
| 3,939,750 | 2/1976 | Inoue et al. | 84/1.01 X |

*Primary Examiner*—Stanley J. Witkowski
*Attorney, Agent, or Firm*—Spencer E. Olson

[57] ABSTRACT

In an electronic musical instrument, such as an electronic organ, the speech characteristics of reed organ pipes are simulated by applying pulses produced by key-actuated tone generators, which pulses are preferably narrow as compared to their repetition frequency, to a low-pass filter, the pass characteristic of which has a relatively sharp knee and a very rapid rate of rolloff, thereby to sharply attenuate the harmonics contained in the pulse which have frequencies above the cutoff frequency. The resultant tone passed by the filter is surprisingly reed-like in character, and by changing the cutoff frequency, reed-like voices of differing properties, imitative for example, of an organ Oboe tone, an orchestral Oboe tone, a Clarinet, a Kinura or a Trompette are obtained. The change in pitch that occurs in a reed organ pipe when the reed is just opening or just closing, which contributes significantly to the unique sound of reed pipes, is simulated by automatically adjusting as a function of time the cutoff frequency of the filter from its lowest cutoff frequency when no keys of the organ are played to the higher cutoff frequency appropriate to produce the desired reed voice. A single automatic filter can be used for all of the notes over a range of many octaves, or separate filters can be used for smaller groups of notes including, for example, some or all of the notes in a single octave. Organ tones simulating "flue" pipes may be produced simultaneously from the same tone generators by conventional filter means.

14 Claims, 14 Drawing Figures

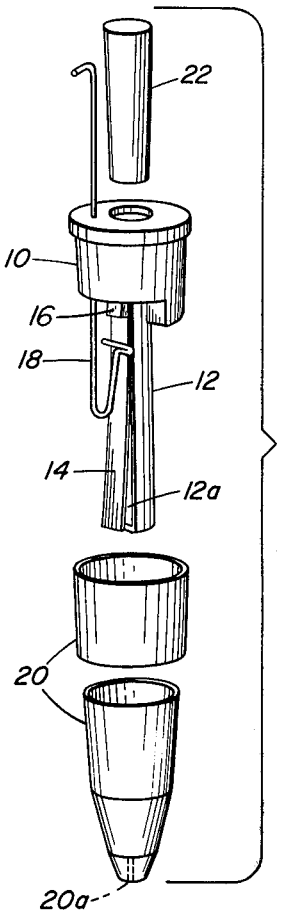
FIG. 1
PRIOR ART
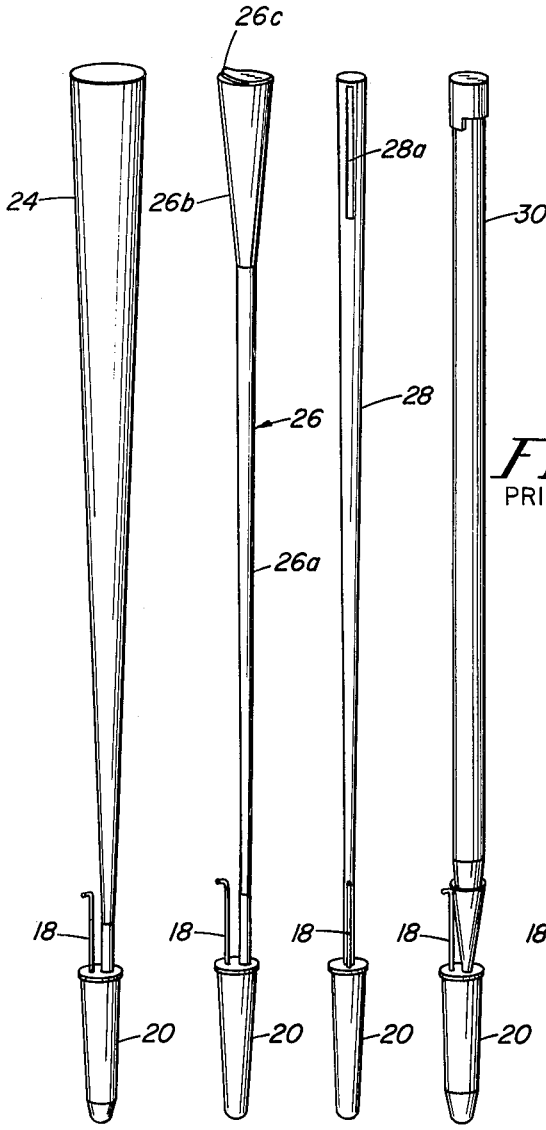
FIG. 2d
PRIOR ART
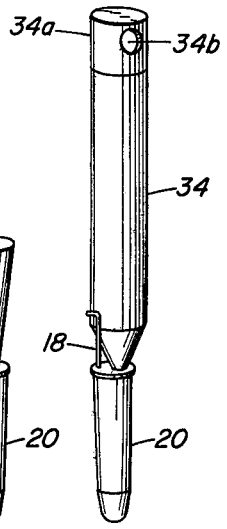
FIG. 2a PRIOR ART
FIG. 2b PRIOR ART
FIG. 2c PRIOR ART
FIG. 2e PRIOR ART
FIG. 2f PRIOR ART
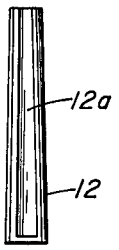
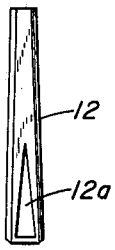
FIG. 1a PRIOR ART
FIG. 1b PRIOR ART
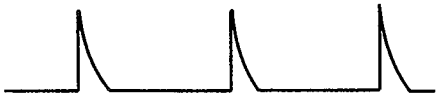
FIG. 3

CIRCUIT FOR IMITATING THE SPEECH CHARACTERISTICS OF REED ORGAN PIPES

FIELD OF THE INVENTION

This invention relates to electrical musical instruments, and more particularly to electronic circuit means for producing tonal effects highly imitative of the speech characteristics of reed organ pipes. The invention relates also to means for deriving reed and flue pipe sounds simultaneously from a common tone generating system, wherein the common origin of the two types of sound is effectively disguised.

BACKGROUND OF THE INVENTION

Over the last several centuries, wind operated pipes have been developed to produce a wide variety of musical sounds. It is customary in pipe organs to provide a separate "set" or "rank" of pipes for each "stop" of the organ. Thus, there might be one rank of sixty-one Diapason pipes (including one pipe for each note), and another rank of sixty-one Flute pipes, and another of sixty-one Trompette pipes, etc. Any particular rank can further be characterized as being made up of "flue" pipes or "reed" pipes. While there are almost countless varieties within each family, flue pipes are all essentially whistles, with the differences in tone color between one flue rank and another being determined by the relative dimensions of corresponding notes, the type of material used in the construction of the pipes, whether the pipes are open or stopped, and other factors.

Reed pipes generate tone in an entirely different manner, in that they employ vibrating brass reeds as the primary source of tone, together with "resonators" for affecting the characteristics of the tone. Over the long period of development of pipe organs, organ reed pipes have been successfully designed to be highly imitative of certain orchestral voices. However, because the natural speech characteristics of a reed, due to its mechanical construction and the operation thereof, are not the same as the speech characteristics of the orchestral instruments they are intended to simulate, it has not been possible to make reeds sound exactly like orchestral voices. Organ reeds none-the-less have a certain quality and charm that cannot be duplicated by orchestral instruments, and it is the object of the present invention to provide an electronic organ that simulates the unique characteristics of reed organ pipes.

A reed organ pipe consists essentially of a reed tube having an opening, called a shallot, cut into one side thereof, against which a brass reed tongue is held by a tuning wire having spring tension, the reed and shallot being enclosed in a boot having an opening at the bottom, which communicates with a windchest to allow air into the pipe when its corresponding valve is operated, and a resonator coupled to the boot. Depending upon the desired organ voice, the resonator takes a variety of forms, such as a tapered, open-ended resonator for a chorus reed stop such as an organ Trompette, a partially closed flared pipe for obtaining an Oboe tone, a slightly tapered pipe with a slot in its wall near its remote end for a more imitative Orchestral Oboe, or capped resonators of various shapes and sizes to achieve other tonal effects. The resonators are usually scaled so as to be approximately one-half the wavelength of the sound of the note to be produced, but many interesting tone qualities are produced by pipes having short length resonators, as for example, the Kinura and Vox Humana.

In operation, the brass reed or tongue vibrates against the shallot, the reed being supported with respect to the shallot so that it essentially "rolls" past the shallot upon opening and closing so as to gradually close the opening; the size and shape of the reed and its curvature relative to the size and shape of the shallot determine the shape of the pulse of air that excites the resonator, which, in turn, determines the tonal quality. The relationship between the reed and the resonator also effect the tonal quality: if the resonator is tuned sharp or flat relative to the tuning reed, the resulting sound is either "choked" or "free", respectively. By appropriately adjusting the shape, configuration and size of the resonator used with a particular reed one can adjust the tone quality of a given pipe over a wide range, making it possible to make organ reed pipes highly imitative of certain orchestral voices. It is again emphasized, however, that the object of the present invention is not to simulate orchestral voices but, rather, to simulate by electronic circuit means the peculiar characteristics of reed pipes, thereby to imitate natural pipe organ voices. It is important that an electronic organ that is intended to imitate a pipe organ, and upon which classical organ literature can be properly interpreted, must be able to imitate both flue and reed pipes. In the interest of economy it is sometimes essential that both types of sound be produced by a common tone generating system. Such attempts however have not been completely successful in that the common origin of the sound has been all too readily apparent. Another important object of this invention. therefore, is to provide means for deriving flue and reed voices simultaneously wherein the reed voices have different speech characteristics as well as different harmonic structures thus to effectively disguise the common origin of the different voices.

It is of course known that the timbre or tonal qualities of the sounds generated by an electronic organ are conventionally achieved by producing an audio frequency signal of the particular waveshape which when reproduced by a loudspeaker produces the desired tonal quality, one common system being characterized as of the "formant" type which starts with a pulse waveshape, for example a rectangular pulse or sawtooth, and uses various filters to attenuate or emphasize desired harmonic frequencies to achieve an audio frequency signal of desired waveshape. For example, Peterson Pat. No. 3,316,341 describes the use of a dynamic filter, a tuned resonant filter that peaks certain frequencies in the audio frequency spectrum and attenuates others, both above and below the frequency to which the filter is tuned, for introducing dynamic variations under player control, in the tone quality of an electrical musical instrument. While the dynamic filter therein described is admirably suited for achieving the sought-after effects, it cannot be used to accurately duplicate or simulate the peculiar speech characteristics of reed organ pipes.

SUMMARY OF THE INVENTION

In accordance with the present invention, the speech characteristics of reed pipes are simulated by applying a train of electrical pulses, simulative of the pulses of air produced as the reed vibrates against the shallot of an organ pipe, which pulses are preferably narrow relative to the repetition frequency of the pulses, to a low-pass filter having a sharp knee and a very rapid rate of rolloff, of the order of 24 dB per octave or greater, above the critical or cutoff frequency, the object being that as the frequency of the harmonics of the pulse signal increases, the amplitude of the output signal from the filter remains essentially constant up to the cutoff frequency and thereafter essentially immediately drops for frequencies above the cutoff frequency. If the pulses are narrow as compared to the repetition rate, they contain large amounts of all of the harmonics up to the 30th or 50th, or even the 100th, depending upon the width of the pulse, and the lower harmonics are about equal in amplitude to the fundamental and only gradually fall off in amplitude at higher orders. It has been found that by using a filter having the described characteristics, with a cutoff frequency in the range of from approximately 2,000 Hz to 8,000 Hz, the resultant output signal produces a sound which is surprisingly reed-like, much more so than any other circuit heretofore used in electronic organs.

To simulate the change in pitch tht occures in a reed pipe when the reed is partially open and as it is closing, particularly when it is just opening, the cutoff frequency of the filter is made automatically adjustable, from its lowest cutoff frequency when no keys of the organ are played to a higher cutoff frequency when a key is played, such higher cutoff frequency permitting several more harmonics to pass through the filter, the number being appropriate to produce the characteristic of a particular reed voice.

BRIEF DESCRIPTION OF THE DRAWINGS

Other objects and features of the invention will become apparent, and its construction and operation better understood from the following detailed description taken in conjunction with the accompanying drawings, in which:

FIG. 1 is an exploded perspective view showing the construction of a typical reed organ pipe;

FIGS. 1A and 1B are front elevation views showing two different shapes of openings in the shallot of a reed organ pipe (prior art);

FIGS. 2A through 2F are perspective views of six different organ pipes, illustrating the construction of resonators employed for obtaining different organ voices (prior art);

FIG. 3 is a diagram showing the nature of the pulses of air developed in a reed organ pipe;

DESCRIPTION OF THE PREFERRED EMBODIMENT

Figure 4:
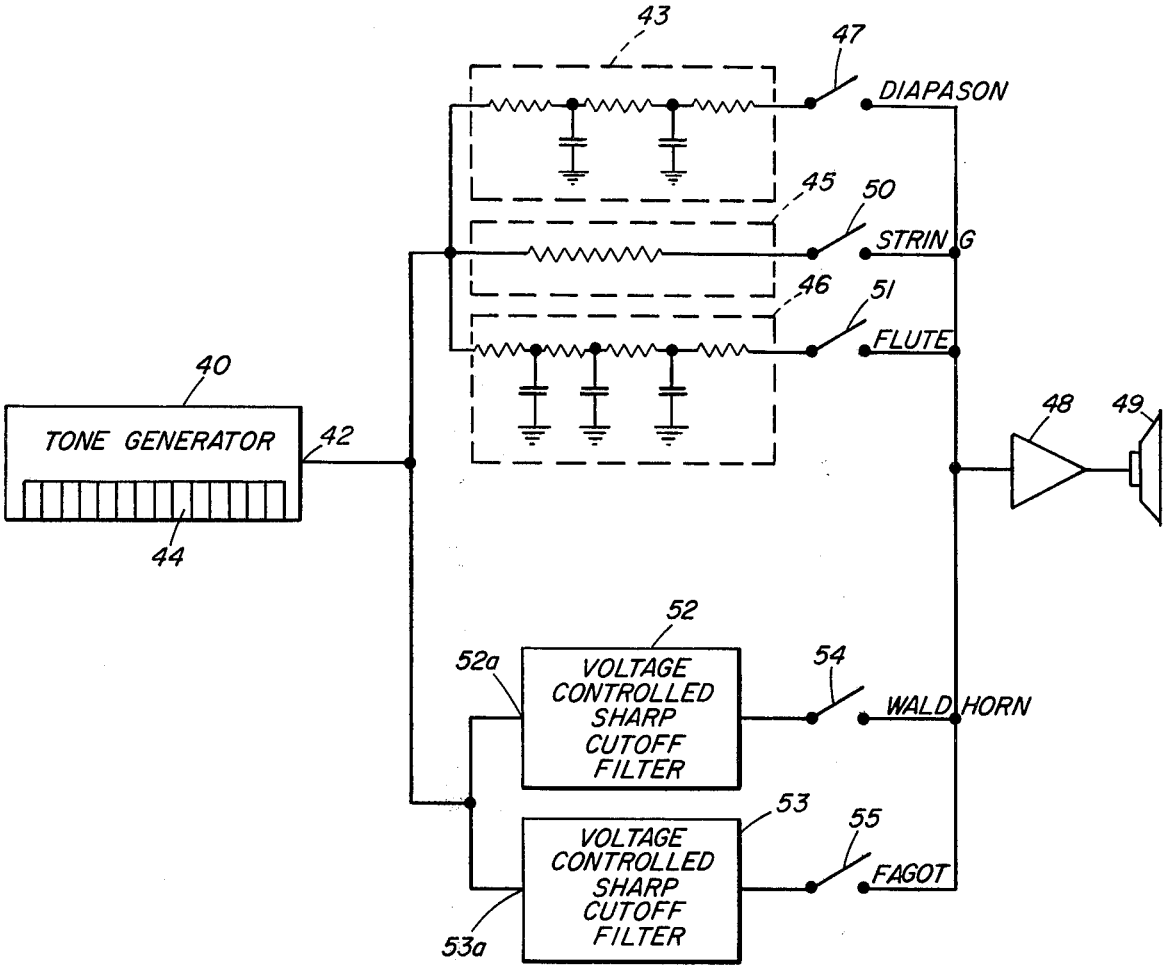
FiG. 4 is a block diagram showing incorporation of the present invention in an electronic organ system.

It being an object of the present invention to electronically simulate the speech characteristics of reed organ pipes, it will be useful for the appreciation of the requirements of the electronic analog to understand how sounds of various tonal qualities are produced in an organ reed pipe. FIG. 1 is an exploded perspective view of a typical reed organ pipe, which consists of a cylindrical block 10 into the lower end of which is affixed a reed tube 12 having an opening 12*a*, called a shallot, cut into one side. A brass reed tongue 14 is secured at its upper end against the reed tube by a wedge 16 and is held against the shallot by a tuning wire 18 having spring tension. The reed is tuned by moving the tuning wire up and down along the tongue to adjust the length of the "free" end of the tongue. The reed pipe is enclosed by a boot 20 having an opening 20*a* at the bottom thereof; the boot is inserted in the windchest of the organ (not shown) from which air at substantially uniform pressure enters the pipe when its corresponding valve is operated. A resonator 22 inserted in the upper end of the block 10 completes the reed organ pipe. The opening in the shallot takes a variety of forms and sizes depending upon the voice it is intended that the reed organ pipe produce, FIG. 1*a* illustrating the front of an "open" shallot in which the opening is generally rectangular and extends substantially the full length of the reed pipe 12, and FIG. 1*b* showing the front of one form of "closed" shallot in which the opening 12*a* starts above the base and forms a pocket at the bottom of the shallot 12.

In operation, as air at substantially constant pressure enters the opening at the bottom of the boot, the brass reed 14 vibrates against the shallot 12*a*, the reed having a curvature such that it essentially "rolls" past the opening as it opens and closes. The shape of the pulses of air produced by the opening and closing of this "valve" and which excite the resonator 22, is determined by the size and shape of the brass tongue 14, its curvature, and the size and shape of the opening in the shallot; the shape of the pulse as the "valve" opens and closes with respect to time determines the tone quality of the reed. The tone quality is also effected by the relationship between the reed and the resonator 22; known resonators are of a wide variety of shapes and/or sizes, and by tuning the resonator sharp or flat relative to the tuning of the reed, a sound which is either choked or free is produced.

FIGS. 2*a* through 2*f* illustrate reasonators of six different types for achieving different organ voices. The relatively long tapered resonator 24 illustrated in FIG. 2*a* is open at its remote end and is used for a chorus reed stop such as an organ Trompette. The resonator 26 shown in FIG. 2*b* comprises a slightly tapered section 26*a* and a shorter, flared portion 25*b*, the remote end of which is partially closed by a cap 26*c* and is used for obtaining an organ Oboe tone. The slightly tapered resonator 28 shown in FIG. 2*c* and having a slot 28*a* cut in the wall thereof near its open outer end is employed for a more imitative Orchestral Oboe. The resonator 30 shown in FIG. 2*d* is capped, and because of its cylindrical shape produces primarily odd order harmonics and is thus imitative of the Clarinet. FIG. 2*e* illustrates the general shape of a Kinura resonator 32, which is much shorter than the previously described resonators, and FIG. 2*f* shows a Vox Humana resonator 34 having a rotatable cup 34*a* for varying the size of a hole 34*b* in the wall of the resonator for controlling the character of the produced tone. The resonators are usually scaled so as to be approximately one-half the wavelength of the sound of the note to be produced, but many interesting tone qualities are produced by pipes having shortlength resonators, as for example, the Kinura and Vox Humana resonators illustrated in FIGS. 2*e* and 2*f*, respectively.

As the reed tongue vibrates against the shallot, pulses of air enter the base of the resonator, which pulses contain many harmonics of substantially equal energy or amplitude. The resonator acts to emphasize some of the harmonics and to attenuate others, depending upon the shape, size and nature of the resonator, to produce a sound having tonal characteristics unique to the particular combination of tuned reed and resonator. When the width of the pulse is small compared to the repetition rate (which is frequently the case) the pulse as it enters the resonator contains all of the harmonics up to perhaps the 100th. The narrower the pulse is the greater the percentage of energy in the higher order harmonics and the greater the uniformity of the amplitudes of the lower-partials. In a sufficiently narrow pulse, the second, third and fourth harmonics are approximately equal in amplitude to the fundamental and the amplitudes of other harmonics are significant and only gradually fall off for the higher order harmonics. For reasons not fully understood, it is characteristic of organ reed pipes that beyond a critical point, higher order harmonics appear to be sharply cut off, this apparently creating the "reed-like" sounds characteristic of such pipes.

The present invention is based on the above-outlined understanding of the mechanics of the reed organ pipe and the recognition that electrical circuits can be designed to produce sound signals having properties analogous to those generated by an acoustical organ reed pipe. It has been found that if a train of electrically generated pulses, preferably narrow in width relative to their repetition frequency, is applied to a low-pass filter having a very sharp cutoff, of the order of at least 24 dB per octave, the resultant tone at the output of the filter, in its steady state condition, is surprisingly reed-like. It is believed that the reed-like sound occurs because all the harmonics contained in the applied pulses, up to the harmonic order that matches the cutoff frequency of the filter, are present at the output of the filter with those harmonics above the cutoff frequency sharply attenuated. By changing the cutoff frequency, to thereby permit more or less of the harmonics contained in the input pulse to appear at the output of the filter, reed-like voices of differing qualities can be obtained. The change in pitch that occurs in a reed organ pipe when the reed is just opening, and which contributes significantly to the unique sound of reed pipes, is simulated by automatically adjusting the cutoff frequency as a function of time from its lowest cutoff frequency to the higher cutoff frequency appropriate to produce the desired reed voice.

FIG. 4 illustrates to general block diagram form the incorporation of the invention in an organ system consisting of a tone signal generator 40 having a terminal 42 for delivering pulse signals from a variety of sources selected at the moment by the player by means of keys 44, which are representative of the keys of an organ or of one manual of a multi-manual organ. The output signals are applied to two sets of parallel channels, a "flue" set and a "reed" set. The "flue" set may consist of one or more channels, three of which, a diapason filter 43, a string filter 45, and a flute filter 46, are shown by way of example. Filter 43 is a conventional R.C. filter having a gradual roll-off which at high frequencies approaches 12 dB per octave and which by its nature has a very gradual knee at its cut-off frequency. The signals from the output of the filter are connected via a stop switch 47 into the amplifier 48 the output of which is connected to the loudspeaker 49. The string "filter" 45 is merely a resistor for connecting the pulses from terminal 42 to the amplifier 48 through the string stop switch 50. Filter 46 is a three-stage, low-pass filter, which like the diapason filter, has a gradual knee. The maximum high frequency attenuation of this filter is 18 dB per octave. A flute stop switch 51 connects the flute tones into the amplifier 48. All of the above filters are conventional and produce reasonable facsimiles of the desired organ pipe sounds.

The "reed" set may likewise include one or more channels, two of which are shown, a first voltage controlled sharp cut-off filter 52 and a second voltage controlled sharp cut-off filter 53. As will be described more fully, filter 52 when adjusted produces the "Waldhorn" sound and the second voltage controlled sharp cut-off filter 53 is adjusted to produce the "Fagot" organ tone. Stop switches 54 and 55 connect the selected tone quality to amplifier 48.

Figure 5:
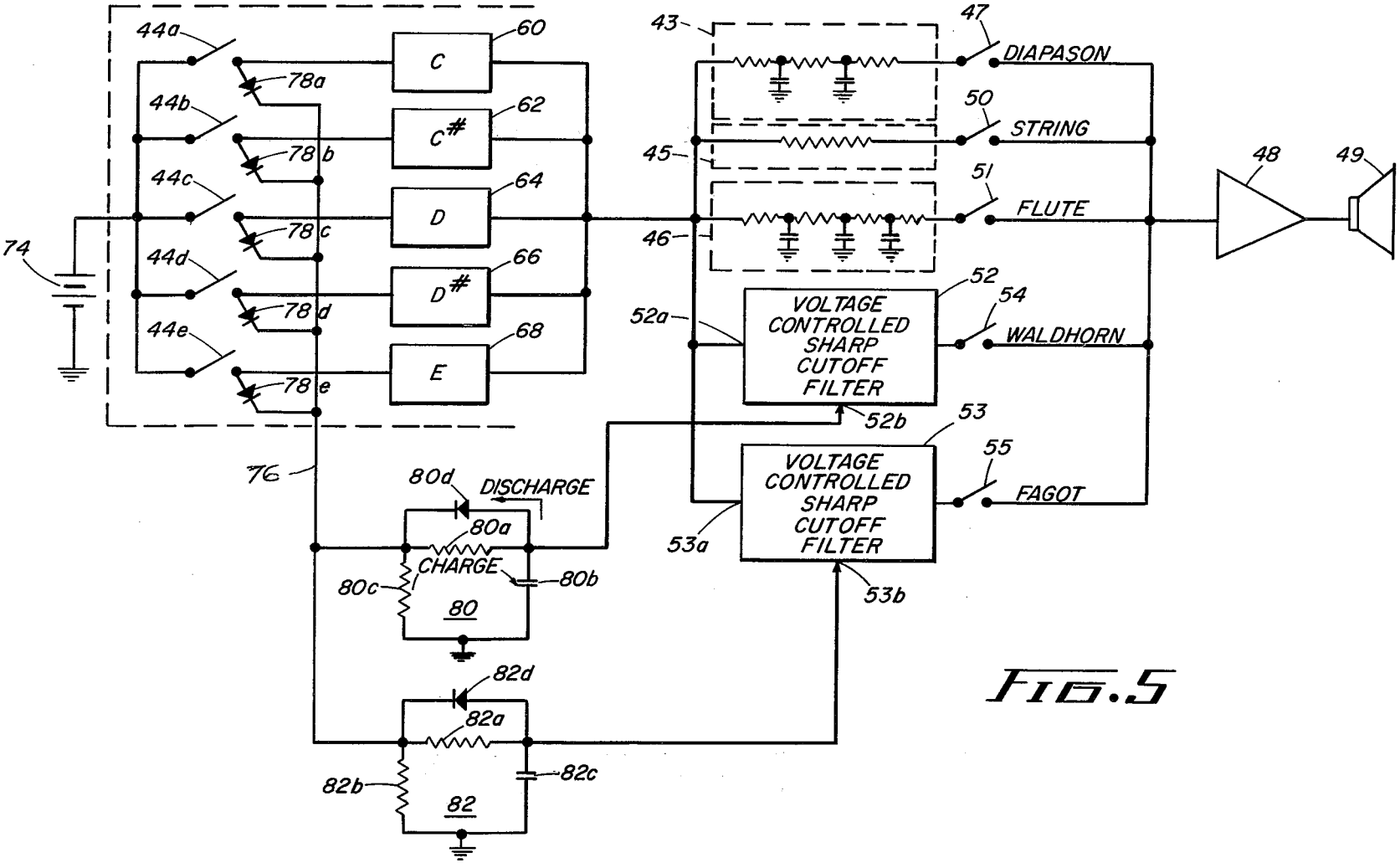
FIG. 5 is a block diagram showing in more detail the system of FIG. 4.

Referring now to FIG. 5 in which certain aspects of FIG. 4, are shown in greater detail, signal generator 40 is shown as consisting of a plurality of oscillators or other type of tone generators 60, 62, 64, 66 and 68, representing just a few of the available notes, and, plurality of switches **44*a*–44*e* which represent keyswitches for individually selecting the notes to be applied to the sharp cut-off filters 52 and 53. That is, if the uppermost switch 44*a* is closed, a pulse train having a repetition frequency corresponding to the note C is applied to the input terminals 52*a* and 53*a* of filters 52 and 53, respectively. As noted earlier, the filters have a very sharp cut-off, and in accordance with another aspect of the invention, their cut-off frequencies are adjustable in response to application of control voltages to terminals 52*b* and 53*b*, respectively. If the control voltage at the control terminal is set to give a given filter a cut-off frequency of approximately 2.0 Kilohertz, the output signal from the filter when applied to the loudspeaker 49** sounds very much like an organ Waldhorn which is a very mellow reed stop similar to the orchestral French Horn. If now the magnitude of the control voltage is changed so as to raise the cutoff frequency of the filter to approximately 2.8 Kilohertz, more harmonics of the applied signal pass through the filter and the resulting output signal produces a tone quality characteristic of the Fagot. As the cut-off frequency is further increased, by even slight amounts, sounds of a strikingly different character are produced as additional high order harmonics are allowed to pass through the filter. The harmonics that are added by reason fo the increase in the cut-off frequency produce a completely different character to the resulting tone, this effect being achieved by reason of the sharpness of the cutoff filter. When the filter is adjusted to a cut-off frequency of around 5.0 Kilohertz, the sound is similar to an organ "Post Horn".

Figure 6:
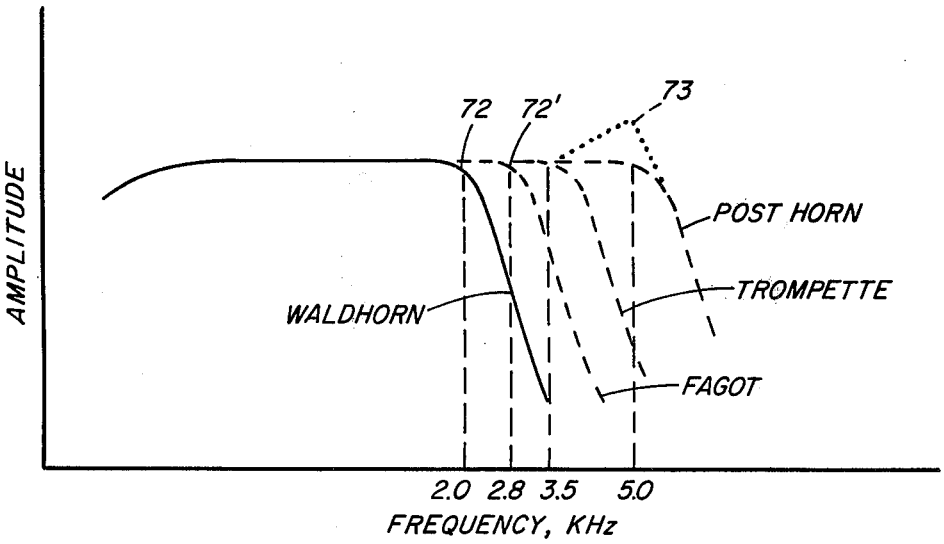
FIG. 6 is a diagram showing the approximate filter characteristics of the sharp cutoff filter utilized in the invention.

The filters 52 and 53 ideally have characteristics as shown in FIG. 6, being essentially flat up to a cut-off frequency, having a sharp knee 72 at the cut-off frequency and a high rate of attenuation, 24 to 30 or more dB per octave for frequencies above the cut-off frequency. If the filter is adjusted to cut-off at 2 Kilohertz (the characteristic shown in solid line) very little energy due to harmonics in the applied signal having frequencies above 2 Kilohertz is transmitted by the filter. If, however, the cut-off frequency is adjusted so that the knee of the filter characteristic is at 72', namely, at 2.8 Kilohertz, much more of the harmonic energy contained in the applied pulses is transmitted by the filter. Even relatively slight changes in the cut-off frequency change the flavor of the resulting sound signal to a marked degree, from very mellow reeds to bright reeds, starting with the Waldhorn at a cut-off frequency of about 2 Kilohertz, and going through the Tuba, the Fagot at a cut-off frequency of about 2.8 Kilohertz, the Trompette at a cut-off frequency of about 3.5 Kilohertz to the Post Horn at a cut-off frequency of about 5 Kilohertz. It has been found that almost any reed pipe can be simulated by appropriate adjustment of the cut-off frequency, a suitable range of cut-off frequencies being between about 2 Kilohertz and approximately 8 Kilohertz.

While the desired tonal quality of the steady state signal is obtained by changing the cut-off frequency of the sharp cut-off filter, it is desirable to also simulate the change in tone quality during the attack period so as to further imitate the unique sound of a reed pipe. The tuning of the reed in an organ reed pipe is very sensitive to changes in the pressure of the air supplied to the pipes, and for this reason the air pressure in a pipe organ is carefully regulated so as to stabilize the tuning of the pipes. However, during the attack and decay of a given pulse of air as the valve is partially opened and as it is closing, but most particularly as it is just opening, the pressure of the air in the pipe necessarily starts out at a lower value than it has after the valve is completely open. Obviously, the valve cannot be actuated from fully closed to fully opened in zero time, and during this transient period the reed will change pitch so as to be a little out of time, this pitch change in itself being part of the characteristic of the reed sound, which, generally speaking, is a greater carrier of the psychological information contained in the sound . . . the thing that makes the reed sound different from orchestral sounds . . . than tuning changes cause in most other musical instruments. It is characteristic of the reed that its sound starts out very mellow and quickly gets bright so that the number of harmonics present at the moment of attack are significantly more limited than the harmonics that are present after the tone has developed. To achieve this effect in the present system the cut-off frequency of the sharp cut-off filter is set, without any keys of the tone generator depressed, to the lowest cut-off frequency that would be at all appropriate to the generation of reed-like sounds, which might be of the order of 0.5 to 2.0 Kilohertz, although it could be lower. When a key is played, a voltage is applied to the filter to cause the cut-off frequency to change as a function of time up to that cut-off frequency at which the particular reed voice it is desired to simulate is produced.

Reverting to FIG. 5, one terminal of each of the keyswitches 44*a*–44*e* is connected to source of DC potential represented by the battery 74, and the other terminal of each of the switches is connected to a respective note generator generating the notes C, C sharp, D, D sharp, E, etc. Each of the switch contacts connected to the tone generators is also connected to a common bus 76 through a respective diode 78*a* – 78*e* so that no matter which key is played, the potential of battery 74 is applied to the bus bar 76. Thus, closure of any one of the keyswitches causes generation of a corresponding note which is applied to the input terminal of the sharp cut-off filters and also applies battery potential to conductor 76. Conductor 76 is connected to a first time constant circuit 80 consisting of resistor 80*a*, capacitor 80*b*, resistor 80*c* and a diode 80*d* connected in parallel with resistor 80*a*, the junction of resistor 80*a* and capacitor 80*b* being connected to the control terminal 52*b* of filter 52. Accordingly, whenever any one of the keyswitches 44 is played, a control voltage is applied to terminal 52*b* of the filter 52 which builds up according to the time constant of the RC curcuit. As the cut-off frequency is shifted from the low cut-off frequency to the desired higher frequency, the tone takes on a character that is amazingly reed-like and has the peculiar attack sound that is characteristic of a reed pipe. The effect is very striking in that the sound produced by the output of the filter without the dynamic shift of the cut-off frequency of the filter is entirely different than the effect with the shift. If desired, resistor 80*a* can be adjusted to determine the highest cut-off frequency that will be reached when the capacitor 80*b* has been fully charged, the capacitance of capacitor 80*b* being selected to make the time constant of the change in frequency of the filter appropriate to the tone quality change that it is desired to create. A second time constant circuit 82 consisting of resistors 82*a* and 82*b*, capacitor 82*c* and diode 82*d* is connected between the control bus 76 and the control terminal 53*b* of the second voltage controlled sharp cut-off filter 53. If the time constant of this circuit is adjusted to be different from that of filter 52, the "attack" and decay characteristic of each of the two reed stops can be made to be quite different. Thus, the flue stops speak with a different characteristic than either reed, and the two reeds are different from one another.

Although there would be some advantage in providing a separate sharp cut-off filter for each note, obviously this would be very costly and would not be practical in organs of low and moderate price. An important aspect and advantage of the present invention is that a single sharp cut-off filter for all of the notes gives remarkably satisfactory results for most purposes.

It is to be understood that the system of FIG. 5 is highly schematic in that each of the tone generators 60 through 68 (and others not illustrated) would include or control an envelope circuit, usually an RC circuit, which would cause the loudness of the pulse to build up as a function of time; if such circuits were not used, the note would turn on and off essentially instantly with a very unmusical "click". It will be recognized by those skilled in the art that oscillators or gating circuits controlled by an applied DC voltage would ordinarily include time constant circuits to cause the tone to build up and decay with a suitble usable smoothness. This, of course, means that if the tone generator produces narrow output pulses the pulse amplitude will change during the attack and decay period, and might be expected to have an effect on the signal appearing at the output of the sharp cut-off filter. However, although the amplitude is changed, the harmonic structure of the pulse is not changed and has the same waveform as the pulse that would be present at the output of the tone generator after the tone has built up to its full, steady state value. As has been described above, the sharp cut-off filter determines the harmonic structure of the signal transmitted by the filter, and advantage is taken of the DC control of the individual tone generators to adjust the attack of the signal delivered by the filter.

Figure 7:
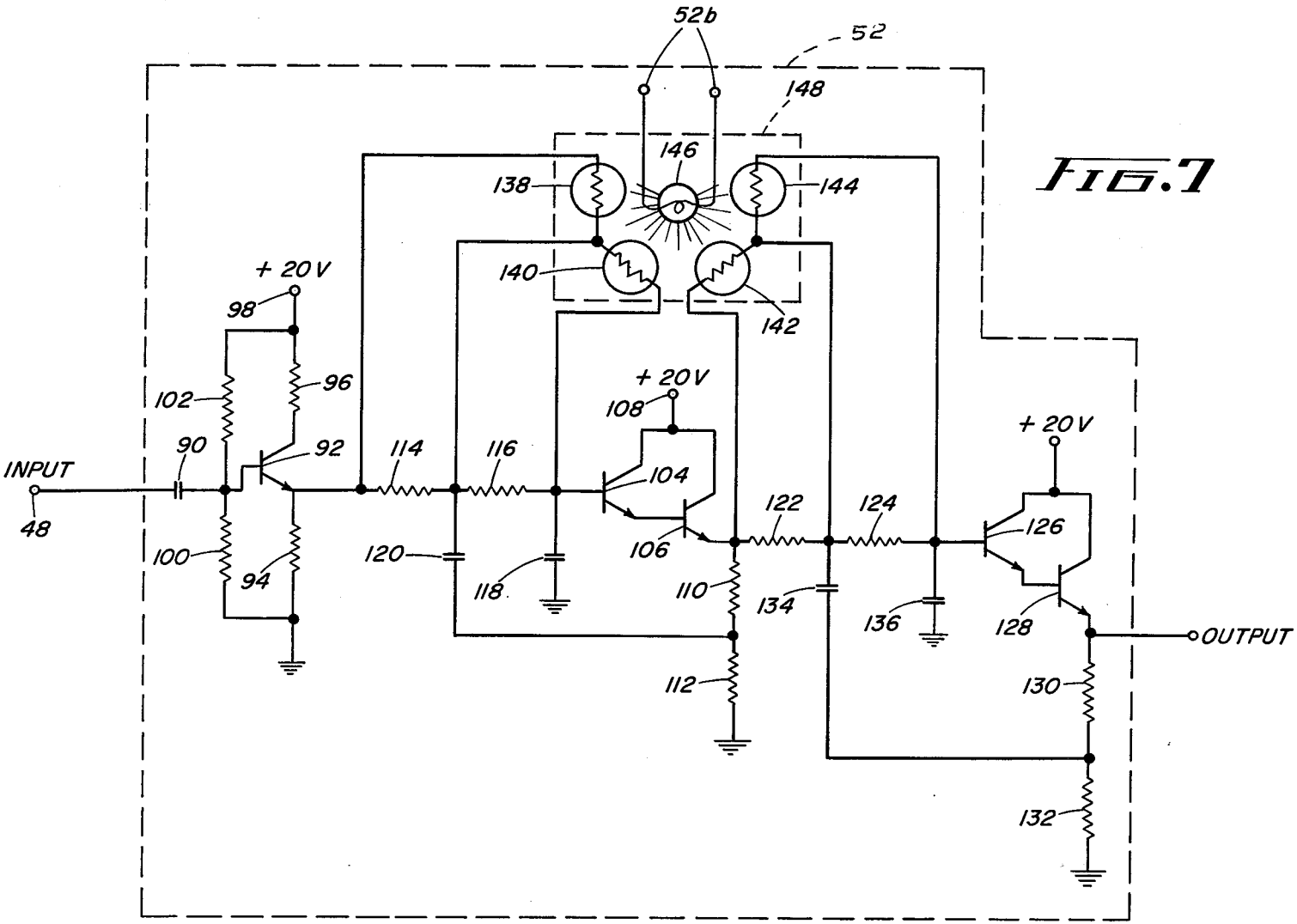
FIG. 7 is a schematic circuit diagram of a voltage controlled sharp cutoff filter for producing sound signals simulative of those produced by a reed organ pipe.

FIG. 7 is a schematic diagram of a voltage-controlled sharp cut-off filter suitable for use in the system of FIG. 5; this filter produces a very steep roll-off above its cut-off frequency at a rate of approximately 24 dB per octave. The tone signal applied to both input terminal 48 is coupled by a capacitor 90 to a conventional emitter follower circuit including transistor 92, the emitter of which is connected through resistor 94 to ground potential and the collector of which is connected through resistor 96 to a source of positive potential, typically +20 volts, represented by terminal 98, and the base electrode of which is connected to ground and to the source of energizing potential through resistors 100 and 102, respectively. This emitter follower circuit functions as an impedance transformer for coupling the signals applied to its input terminal connection suitable for connection to the input of the filter. The filter itself includes transistors 104 and 106 connected to form a Darlington pair, with the collector electrode connected to a source of positive potential, typically 20 volts, represented by terminal 108, and also connected in emitter follower configuration. The load resistor of this emitter follower consists of resistors 110 and 112, the resistance of resistor 112 being about nine times higher than that of resistor 110. Resistors 114 and 116 connected in series between the emitter of transistor 92 and the base electrode 104, together with capacitors 118 and 120, determine the cut-off frequency of the filter. Resistors 114 and 116 and capacitors 118 and 120 form a conventional two-stage RC filter except that the bottom terminal of capacitor 120 is returned to the junction of resistors 110 and 112 instead of to ground. At frequencies below which capacitors 118 and 120 represent a very high impedance as compared to the impedances of resistors 114 and 116 the voltage at the base of transistor 104 is faithfully reproduced at the emitter of transistor 106, and by virtue of the voltage division between resistors 110 and 112, approximately one-tenth of this voltage is fed back to the bottom terminal of capacitor 120. Because of this feed back connection, capacitor 120 has its effective capacitance reduced to approximately one-tenth of its actual capacitance. At frequencies at which the impedance of capacitors 118 and 120 begin to become significantly low compared to the resistance of resistors 114 and 116, the phase and amplitude of signals appearing at the base of transistor 104 will be different than the phase and amplitude of the signals appearing at the upper terminal of capacitor 120. The voltage at the emitter of transistor 106 "follows" the base voltage and consequently the voltage fed back to the bottom terminal of capacitor 120 will decrease and its effective capacitance becomes closer to its actual capacitance. In this manner the effectiveness of the filter is increased, particularly the sharpness of its cutoff.

The emitter of transistor 106 is connected to another filter section identical to the one just described, consisting of resistors 122 and 124 connected in series between the emitter of transistor 106 and the base electrode of transistor 126, which together with transistor 128 forms another Darlington pair, also connected in emitter follower configuration. Resistors 130 and 132 connected in series between the emitter of transistor 128 and ground form the load resistor of this emitter follower, the junction of resistors 130 and 132 being connected to the bottom terminal of capacitor 134, the other terminal of which is connected to the junction of resistors 122 and 124. The base electrode of transistor 126 is connected via capacitor 136 to ground. The audio frequency output signal from the filter is taken from the emitter of transistor 128, and the two filter sections in cascade produce the desired roll of the 24 dB per octave.

The cutoff frequency of the filter is varied between predetermined limits by varying the effective resistance of resisters 114, 116, 122 and 124. This is accomplished by connecting light-sensitive resistors 138, 140, 142 and 144 in parallel with resistors 114, 116, 122 and 124, respectively, and varying the intensity of light illuminating the light-sensitive resistors. This is accomplished by varying the intensity of a lamp 146 in accordance with the DC control voltage generated as described in connection with FIG. 5 to the terminals **52*b* of the lamp. The lamp and the four light-sensitive resistors are enclosed in a light-tight container 148**. The lamp is shown as being of the incandescent variety, but it of course could alternatively be a light emitting diode or other type lamp.

Alternatively, other types of low-pass filters can be employed, as, for example, those using field effect transistors as voltage controlled resistance elements for adjusting and varying the cutoff frequency of the filter, or those using variable transconductance devices. Many types of low-pass filters can be adjusted to produce a rise in output at or near the cutoff frequency. Such quasi-resonant low-pass filters are of course fully equivalent to a straight low-pass filter for the purposes disclosed. The dotted line "hump" 73 in FIG. 6 illustrates this type of response.

While the present invention has been disclosed by means of specific illustrative embodiments thereof, it will be obvious to those skilled in the art that various modifications can be made without departing from the spirit of the invention as defined in the appended claims.

For example, although in the described system the output signals from both sets of filters are applied to a common loudspeaker, it will be understood that the output signals from the flue stop filters may be applied to one transducer with the output signals from the controllable filter circuits applied to another transducer, such that the output signals are accoustically combined. As another alternative, the output signals from each of the filter circuits may be applied to a respective transducer.

I claim:

1. In an electronic organ, a circuit for imitating the speech characteristics of reed organ pipes, comprising.

a signal source for producing a plurality of tone signals, one for each note of the musical scale, said tone signals being rich in natural harmonics, at least one controllable sharp cutoff low-pass filter circuit means connected to said signal source to receive player-selectable signals therefrom, said filter circuit means having a cutoff frequency controllable over a range between a first frequency and a second higher frequency and a rate of roll-off above the cutoff frequency of substantially 24 dB per octave, a source of control potential, player-controlled means for selecting desired ones of said tones and for coupling from said source of potential a control voltage to said filter circuit means upon actuation of said player-controlled means, said controllable filter means being operative in response to said control voltage to adjust its cutoff frequency from said first frequency to said second higher frequency, thereby to cause harmonics present in said selected tones having frequencies higher than said second frequency to be abruptly and sharply attenuated, and transducer means connected to said controllable filter circuit means to receive signals therefrom and to convert the signals to a sound signal.

2. The combination according to claim 1, wherein said controllable filter circuit means has said first cut-off frequency when said signal source is not activated and further includes a source of DC potential, and means including said player-controlled means for applying said DC potential to said controllable filter circuit means as a control voltage for controllably adjusting the cut-off frequency thereof from said first to said second higher frequency.

3. The combination according to claim 2, wherein said last-mentioned means further includes time constant circuit means for coupling said DC potential to said controllable filter circuit means whereby to controllably adjust as a function of time the cut-off frequency of said filter circuit means from said first frequency to said second higher frequency.

4. The combination according to claim 3, wherein said time constant circuit includes at least one resistor and a capacitor, and wherein said resistor is adjustable between first and second resistance values determinative of the lower and upper limits, respectively, when said capacitor is fully charged, of a range of cut-off frequencies between said first and said second frequencies, and said capacitor has a value of capacitance to make the rate of change of the cut-off frequency to said second higher frequency appropriate to the tone quality of the reed organ pipe voice it is desired to simulate.

5. The combination according to claim 3, wherein said controllable filter circuit means comprises, active RC filter means having a plurality of sections each of which includes at least a resistor, and means responsive to said control voltage for changing the effective resistance of each of said resistors whereby to adjust the cutoff frequency of said controllable filter circuit means from said first to said second higher frequency.

6. The combination according to claim 5, wherein said last-mentioned means comprises, a light-sensitive resistor connected in parallel with each of the resistors of said RC filter means, the resistances of which vary as a function of illumination, and a light source adapted to deliver illumination to all said light-sensitive resistors and connected to receive said control voltage for simultaneously varying the illumination of all said resistors.

7. In an electronic organ, a circuit for imitating the speech characteristics of reed organ pipes, comprising:

a signal source for producing a plurality of tone signals rich in natural harmonics, one for each note of a musical scale, a plurality of controllable sharp cutoff low-pass filter circuit means each connected to said signal source to receive player-selectable signals therefrom, said controllable filter means each having a cutoff frequency controllable over a range between a first frequency and a second higher frequency and a rapid rate of roll-off above their respective cutoff frequencies, said controllable filter circuit means having different second cut-off frequencies appropriate to the tone quality of a like plurality of different reed organ pipes it is desired to simulate, a source of DC potential, player-controlled means for selecting desired ones of said tones and for coupling said DC potential to each of said controllable filter means upon actuation of said player-controlled means as a control voltage for controllably adjusting as a function of time the cutoff frequencies of said filter circuit means from their respective first frequencies to their respective second higher frequencies, transducer means connectable to said plurality of controllable filter circuit means to receive signals therefrom and to convert the signals to a sound signal, and stop switch means for selectively connecting desired ones of said controllable filter circuit means to said transducer means.

8. The combination according to claim 7, further including at least one passive filter circuit connected to said signal source to receive therefrom the same player-selectable signals as are received by said controllable filter circuit means, said passive filter circuit having a transfer characteristic to be operative to produce a signal representative of the voice of a flue organ pipe, and means for applying the signal from said passive filter circuit to said transducer means.

9. The combination according to claim 8, including a plurality of passive filter circuits each connected to said signal source to receive therefrom the same player-selectable signals as are received by said controllable filter circuit means, the transfer characteristics of said passive filters being different from each other and each being operative to produce an output signal representative of the voice of a different flue organ pipe, and stop switch means for selectively applying desired ones of said output signals to said transducer means.

10. In an electronic organ, the combination comprising:

a signal source for producing a plurality of tone signals, one for each note of the musical scale, said tone signals being rich in natural harmonics, at least one flue stop filter circuit means connected to said signal source to receive player-selectable signals therefrom, said at least one flue stop filter circuit means having a transfer characteristic operative to produce an output signal representative of the voice of a given flue organ pipe, at least one voltage controllable sharp cutoff low-pass filter means having a control element and a cut-off frequency controllable over a range from a first frequency to a second higher frequency, and a rapid rate of roll-off above the cutoff frequency, connected to said signal source to receive therefrom the same player-selectable signals received by said at least one flue stop filter circuit means, transducer means for converting the output signals from said flue stop filter circuit means and from said controllable filter circuit means to sound signals, a source of DC potential, and player-controlled means for selecting desired ones of said tone signals and for applying said DC potential to the control element of said at least one controllable filter circuit means upon selection of one or more tone signals, for adjusting as a function of time the cutoff frequency of said at least one controllable filter circuit means from said first to said second frequency for producing an output signal representative of the voice of a given reed organ pipe, the sound signals resulting from the output signals from the different filter means having distinctively different organ voice characteristics and when simultaneously reproduced create the illusion to the listener of two individual voices rather than a single composite signal.

11. Apparatus according to claim 10 including a plurality of flue stop filter circuit means all connected to receive player-selectable tone signals from said signal source, the transfer characteristics of said flue stop filter circuit means being different from each other and being operative to produce separate output signals representative of the voices of different flue organ pipes, stop switch means for selectively connecting desired ones of said flue stop filter circuit means to said transducer means, a plurality of voltage controllable sharp cutoff low-pass filter circuit means all connected to receive from said signal source the player-selectable signals received by said flue stop filter circuit means and each having a second cutoff frequency differing from the second cut-off frequencies of the others, stop switch means for selectively connecting desired ones of said controllable filter means to said transducer means, and wherein said player-controlled means includes means for applying said DC potential to the control element of respective ones of said controllable filter circuit means for adjusting as a function of time their respective second cutoff frequencies for producing separate output signals representative of the voices of different reed organ pipes.

12. Apparatus according to claim 10, wherein said player-controlled means includes at least one time constant circuit means for controlling as a function of time application of said DC potential to the control element of said at least one controllable filter circuit means.

13. Apparatus according to claim 11, wherein said player-controlled means includes a like plurality of time constant circuit means for separately controlling as a function of time application of said DC potential to the control element of respective ones of said plurality of controllable filter circuit means.

14. Apparatus according to claim 13, wherein the time constants of said time constant circuit means are different from each other whereby to adjust as different functions of time their respective controllable filter means to their respective second cutoff frequencies.

* * * * *